US011808077B2

(12) United States Patent
Ellenberger

(10) Patent No.: US 11,808,077 B2
(45) Date of Patent: Nov. 7, 2023

(54) PATIO DOOR ASSEMBLY

(71) Applicant: Associated Materials, LLC, Cuyahoga Falls, OH (US)

(72) Inventor: Eddie Dean Ellenberger, Akron, OH (US)

(73) Assignee: Associated Materials, LLC, Cuyahoga Falls, OH (US)

( * ) Notice: Subject to any disclaimer, the term of this patent is extended or adjusted under 35 U.S.C. 154(b) by 63 days.

(21) Appl. No.: 17/652,893

(22) Filed: Feb. 28, 2022

(65) Prior Publication Data

US 2023/0272667 A1 Aug. 31, 2023

(51) Int. Cl.

| | |
|---|---|
| ***E06B 1/26*** | (2006.01) |
| ***E06B 3/46*** | (2006.01) |
| ***E06B 1/62*** | (2006.01) |
| ***E06B 1/70*** | (2006.01) |
| ***E06B 1/52*** | (2006.01) |
| *E06B 3/22* | (2006.01) |

(52) U.S. Cl.

CPC ..... *E06B 3/46* (2013.01); *E06B 1/26* (2013.01); *E06B 1/52* (2013.01); *E06B 1/62* (2013.01); *E06B 1/70* (2013.01); *E06B 3/4618* (2013.01); *E06B 3/4636* (2013.01); *E06B 2001/622* (2013.01); *E06B 2003/225* (2013.01)

(58) Field of Classification Search

CPC .. E06B 3/4618; E06B 3/4636; E06B 3/26305; E06B 2003/224; E06B 2003/225; E06B 1/6084; E06B 1/20; E06B 1/56; E06B 1/603; E06B 3/46; E06B 1/26; E06B 1/52; E06B 1/62; E06B 1/70; E06B 2001/622

See application file for complete search history.

(56) References Cited

U.S. PATENT DOCUMENTS 4,589,464 A * 5/1986 Coller ..... E06B 9/52 160/91
4,599,836 A * 7/1986 Melcher ..... E06B 5/003 52/202

(Continued)

FOREIGN PATENT DOCUMENTS

DE 102008015989 B3 * 11/2009 ..... E06B 1/70
DE 102009055770 A1 * 5/2011 ..... E06B 1/70

(Continued)

*Primary Examiner* — Phi D A

(74) *Attorney, Agent, or Firm* — Knobbe, Martens, Olson & Bear LLP

(57) ABSTRACT

A patio door assembly includes a panel with a glass unit, and a polymer frame including a bottom member with a sill platform. A support beam is coupleable to the bottom member over the sill platform. The support beam defines a first channel between a top surface of the support beam and a platform, defines a second channel between the platform and the sill platform, a slot defined in the platform of the support beam. A structural insert is insertable in an end of the support beam and can be positioned in the support beam such that the structural insert supports a setting block for the glass unit of the panel to facilitate transferring a weight of the panel to the sill platform. The structural insert inhibits deformation of the frame when the patio door assembly is exposed to a high temperature environment (e.g., a desert environment).

20 Claims, 6 Drawing Sheets

(56) References Cited

U.S. PATENT DOCUMENTS 4,993,204 A * 2/1991 Kuritsky ..... E04C 2/384 52/656.2
5,325,648 A * 7/1994 Menard ..... E06B 1/70 52/456
6,289,635 B1 * 9/2001 Procton ..... E06B 7/26 49/467
6,371,188 B1 * 4/2002 Baczuk ..... E06B 7/14 49/467
8,584,410 B2 * 11/2013 Furgerson ..... E06B 1/26 49/504
10,202,794 B1 * 2/2019 Careri ..... E06B 1/34
11,365,582 B1 * 6/2022 Salvoni ..... E06B 1/52
2005/0034388 A1 * 2/2005 Bealko ..... E06B 1/003 52/204.5
2007/0297854 A1 * 12/2007 Ohrstrom ..... E06B 3/9647 403/401
2008/0229676 A1 * 9/2008 Allen ..... E06B 1/62 29/33 R
2010/0192469 A1 * 8/2010 McDaniel ..... E06B 1/70 49/471
2010/0307078 A1 * 12/2010 Young ..... E06B 5/11 52/745.15
2014/0102017 A1 * 4/2014 Booi ..... E06B 1/56 52/204.1
2015/0007502 A1 * 1/2015 Poppema ..... E06B 9/522 49/471
2015/0159428 A1 * 6/2015 Johnson ..... E06B 7/14 49/471
2016/0340970 A1 * 11/2016 Mitchell ..... E06B 7/2305
2018/0100345 A1 * 4/2018 Meeks ..... E06B 7/14
2019/0194991 A1 * 6/2019 Fontijn ..... E06B 3/46
2020/0408016 A1 * 12/2020 Hernandez ..... E05D 15/0665
2021/0277710 A1 * 9/2021 Edlin ..... E06B 1/36
2022/0389753 A1 * 12/2022 Fontijn ..... E06B 1/70

FOREIGN PATENT DOCUMENTS

EP 1582687 A2 * 10/2005 ..... E06B 1/70
GB 2061360 A * 5/1981 ..... E06B 1/70
KE 20080081474 A * 10/2008 ..... E06B 1/70
KE 20140106370 A * 10/2014 ..... E06B 1/70
WO WO-2019168840 A1 * 9/2019 ..... E05D 15/0604

* cited by examiner

PATIO DOOR ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

Aspects of the present disclosure are directed to a patio door assembly, and more particularly to a patio door assembly with a polymer frame and structural inserts insertable into a support beam for the glass unit to transfer weight of the glass unit to the sill.

Description of the Related Art

Patio doors include a fixed door panel and a movable door panel attached to a frame. In some patio doors, the frame is made of polyvinyl chloride (PCV). However, when subjected to high temperatures (e.g., under direct and reflected sunlight), the polymer frame may deform, affecting the performance and stability of the patio door.

SUMMARY

Accordingly, there is a need for an patio door assembly with a polymer frame that can withstand high temperature environments (e.g., desert environments) without deformation of the frame that can affect the performance or stability of the patio door.

In accordance with one aspect of the disclosure, a patio door assembly is provided. The assembly includes a frame including a left member, a right member, a top member and a bottom member. The assembly also includes a first panel fixedly mounted to the frame, and a second panel movably mounted to the frame and being movable relative to the first panel. The bottom member includes a sill platform, and a support beam that is coupleable to the bottom member over the sill platform. The support beam defines a first channel between a top surface of the support beam and a platform and defines a second channel between the platform and the sill platform, a slot defined in the platform of the support beam. A structural insert is insertable in opposite ends of the support beam and is configured to be positioned in the support beam such that the structural insert supports a setting block for a glass unit of the first panel to facilitate transferring a weight of the first panel to the sill platform. The structural insert has a first portion sized to fit in the first channel, a second portion sized to fit in the second channel, and a neck portion that interconnects the first portion and the second portion, the neck portion sized to fit in the slot in the platform of the support beam.

In accordance with another aspect of the disclosure, a patio door assembly is provided. The assembly comprises a panel including a glass unit, and a frame including a bottom member. The panel is fixedly mounted to the frame, the bottom member including a sill platform. A support beam is coupleable to the bottom member over the sill platform. The support beam defines a first channel between a top surface of the support beam and a platform and defines a second channel between the platform and the sill platform, a slot defined in the platform of the support beam. A structural insert is insertable in opposite ends of the support beam and configured to be positioned in the support beam such that the structural insert supports a setting block for a glass unit of the first panel to facilitate transferring a weight of the first panel to the sill platform. The structural insert has a first portion sized to fit in the first channel, a second portion sized to fit in the second channel, and a neck portion that interconnects the first portion and the second portion, the neck portion sized to fit in the slot in the platform of the support beam.

In accordance with another aspect of the disclosure, a frame for a patio door assembly is provided. The frame includes a bottom member including a sill platform. The frame also includes a support beam that is coupleable to the bottom member over the sill platform and is configured to receive a glass unit of a fixed panel thereon. The support beam defines a first channel between a top surface of the support beam and a platform and defines a second channel between the platform and the sill platform, a slot defined in the platform of the support beam. A structural insert is insertable in an end of the support beam and is positionable in the support beam such that the structural insert is configured to support a setting block for the glass unit of the fixed panel to facilitate transferring a weight of the fixed panel to the sill platform. The structural insert has a first portion sized to fit in the first channel, a second portion sized to fit in the second channel, and a neck portion that interconnects the first portion and the second portion, the neck portion sized to fit in the slot in the platform of the support beam.

DETAILED DESCRIPTION

Figure 1:
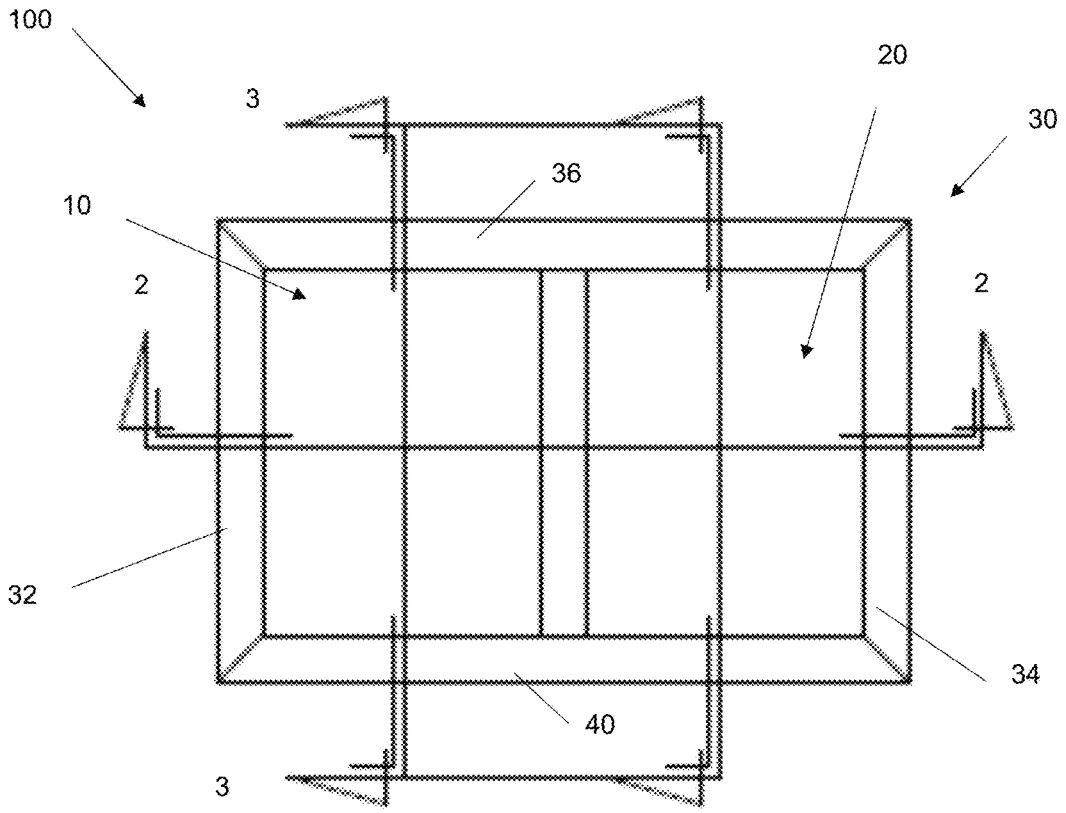
FIG. 1 is a schematic front view of a patio door assembly.
Figure 2:
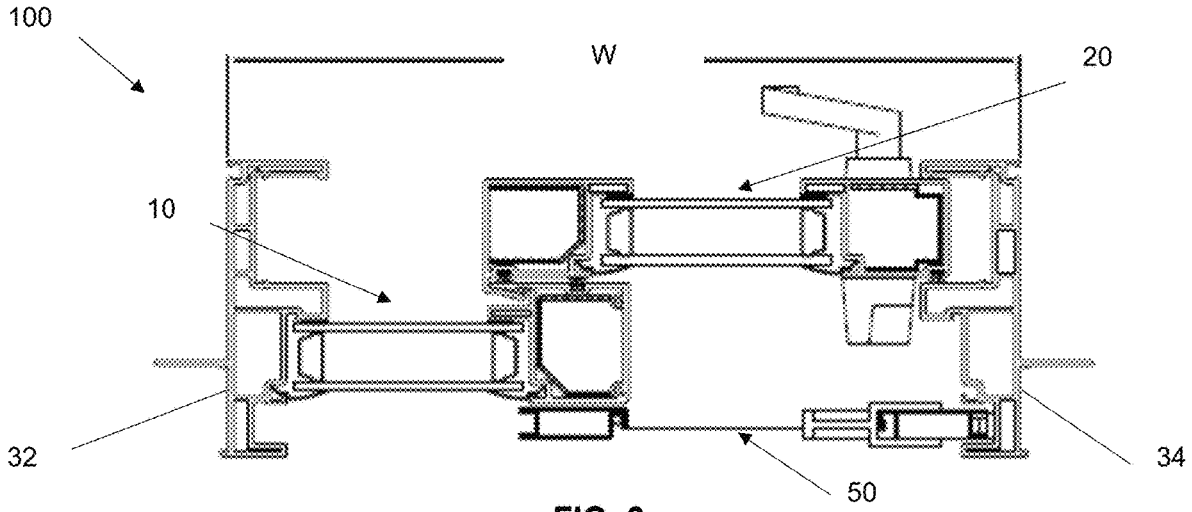
FIG. 2 is cross-sectional view of the patio door assembly of FIG. 1 along section line 2-2 in FIG. 1.
Figure 3:
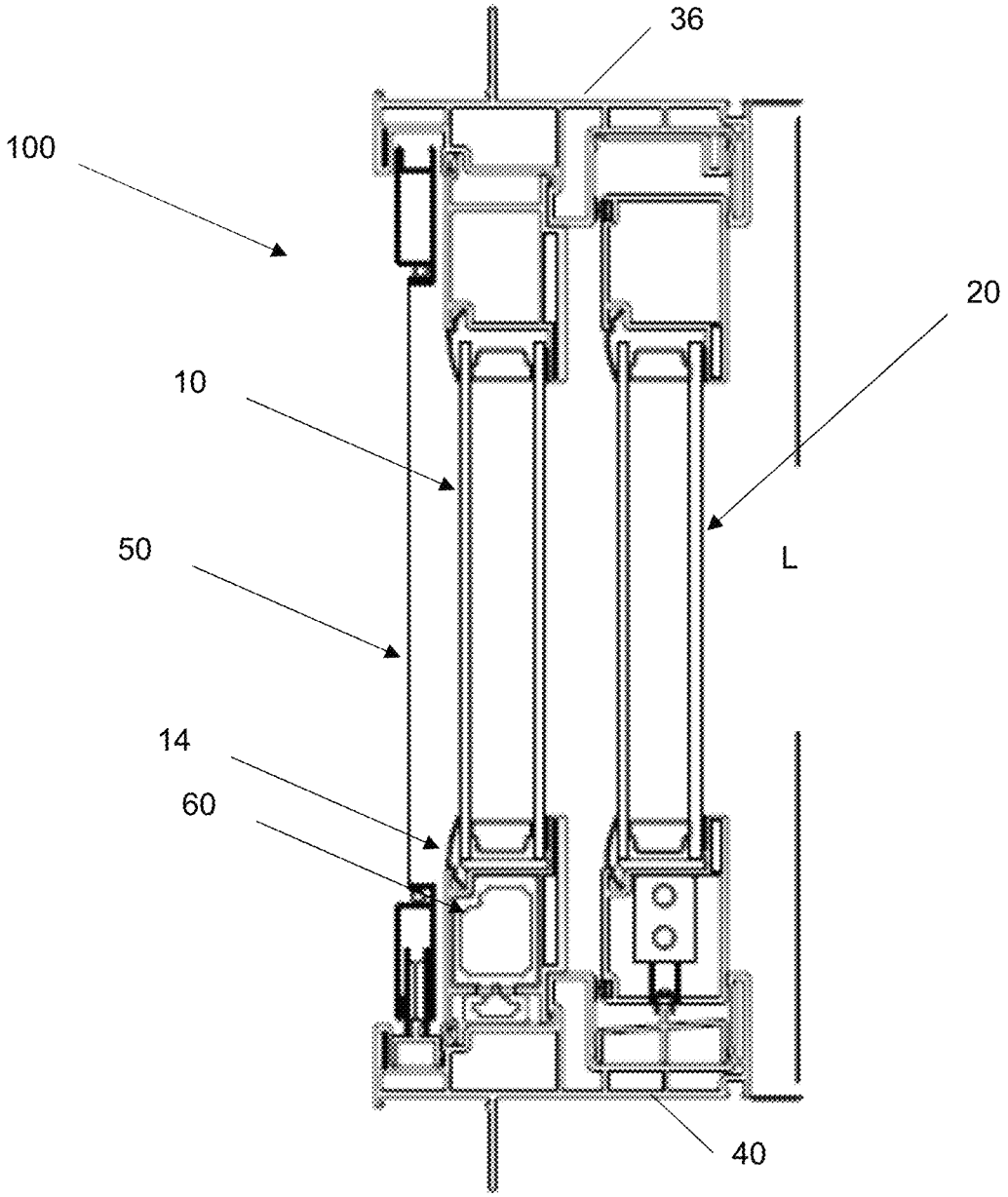
FIG. 3 is a cross-sectional view of the patio door assembly, as taken along section line 3-3 in FIG. 1.

FIGS. 1-3 show a patio door assembly 100. The patio door assembly 100 includes a fixed panel 10 (e.g., first panel) and a movable panel 20 (e.g., second panel, movable patio door) coupled to a frame 30. The frame 30 can be made of a polymer (e.g., polyvinyl chloride or PVC). The frame 30 includes a left member 32, a right member 34, a top member 36 and a bottom member (e.g., sill) 40. A second movable panel 50 (e.g., third panel, see FIG. 2), such as a screen, can be movably coupled to the frame 30. The patio door assembly 100 has a width W (e.g., between the edges of the left member 32 and the right member 34) and a height L (e.g., between the edges of the top member 36 and the bottom member 40. FIG. 3 shows a structural insert 60 below the fixed panel 10 that advantageously allows (e.g., facilitates) transfer of the weight of the fixed panel 10 to the sill or bottom member 40, as further discussed below. The structural insert 60 allows the patio door assembly 100 (e.g., the frame 30) to withstand high temperatures when exposed, for example, to direct and reflected sunlight. For example, the structural insert 60 allows the patio door assembly 100 to inhibit (e.g., prevent) deformation of the sill or bottom member 40 at temperatures of up to 250° F. external surface temperature.

Figure 4A:
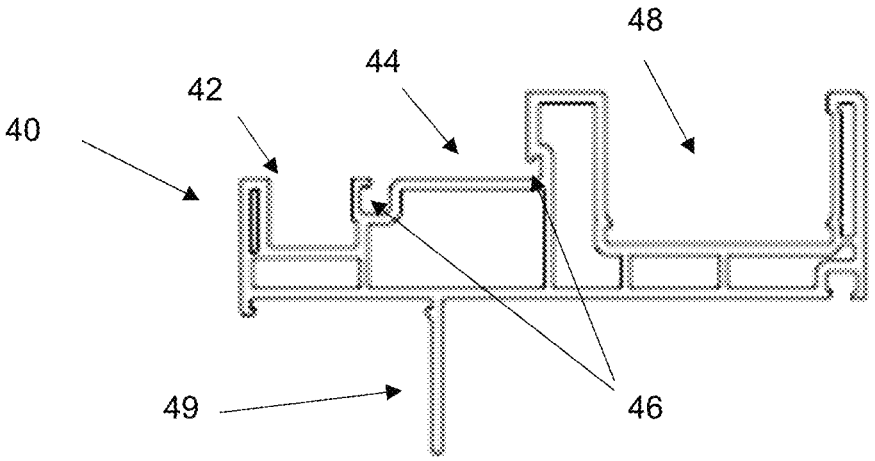
FIG. 4A is a schematic view of a lower frame for the patio door assembly of FIG. 1.

FIG. 4A shows one implementation of the bottom member 40 or sill. The bottom member includes a first channel 42 that movably receives a portion of the second movable panel 50 (e.g., screen) therein. The bottom member 40 also includes a sill platform 44 and locking members 46 (e.g., hook portions) at front and rear edges of the sill platform 44. The bottom member 40 also includes a second channel 48 that movably receives a portion of the movable panel 20 (e.g., movable patio door) therein. The bottom member 40 includes a nail fin 49 via which the bottom member 40 can be coupled to a frame (e.g., to a standard wood frame).

Figure 4B:
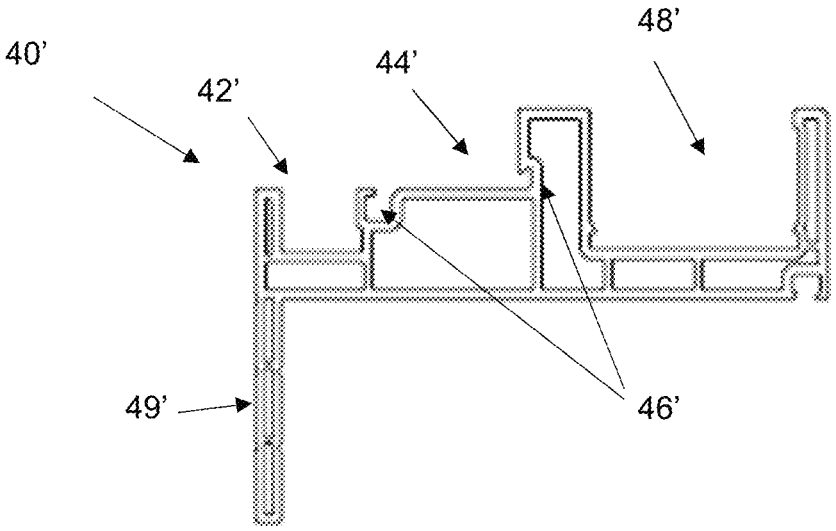
FIG. 4B is a schematic view of a lower frame for the patio door assembly of FIG. 1 when used with a stucco frame.

FIG. 4B shows a bottom member 40'. Some of the features of the bottom member 40' are similar to features of the bottom member 40 in FIG. 4A. Thus, reference numerals used to designate the various features or components of the bottom member 40' are identical to those used for identifying the corresponding features of components of the bottom member 40 in FIG. 4A, except that a "'" has been added to the numerical identifier. Accordingly, the structure and description for the various features of the bottom member 40 of FIG. 4A are understood to also apply to the corresponding features of the bottom member 40' in FIG. 4A, except as described below.

The bottom member 40' differs from the bottom member 40 in that instead of a nail fin 49, the bottom member 40' has a front panel 49' aligned with a front of the bottom member 40'. The bottom member 40' can be used when the patio door assembly 100 is installed on a stucco frame.

Figure 5A:
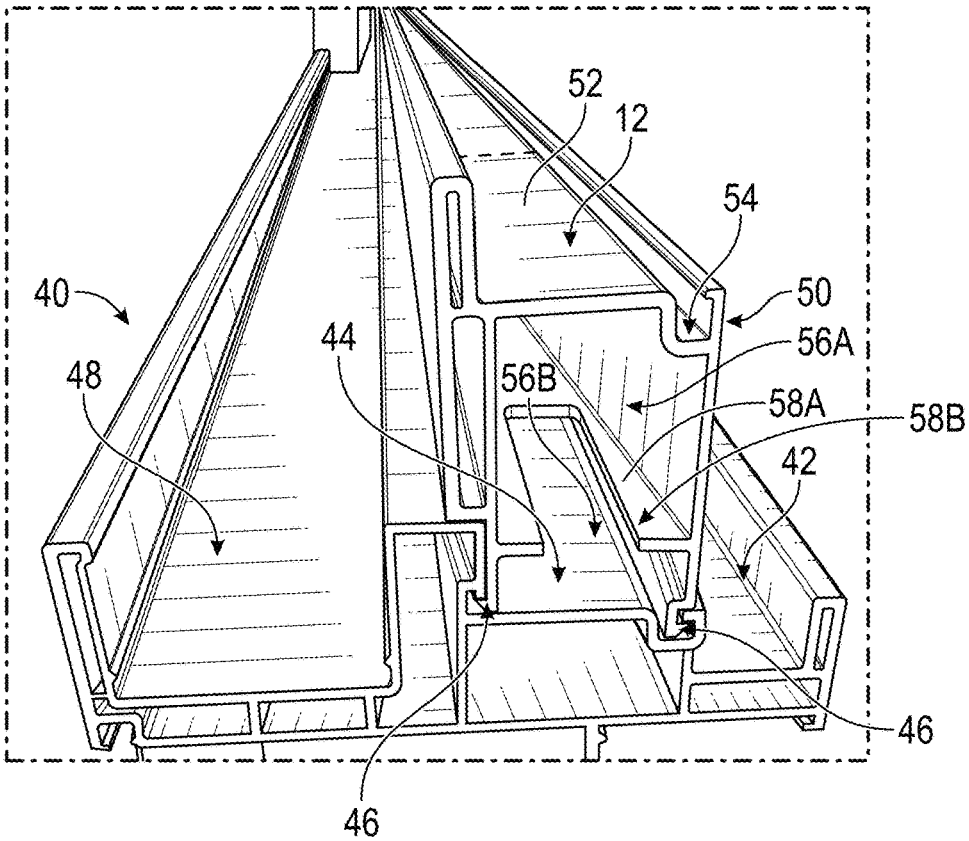
FIG. 5A is a perspective view of the lower frame of the patio door assembly of FIG. 1 with the panel support beam attached.

FIG. 5A shows an end view of the bottom member 40. A support beam 50 is coupled (e.g., via the locking members 46) to the bottom member 40 over the sill platform 44. The support beam 50 hat a top surface 52 that can support the fixed panel 10 (not shown) thereon and a channel 54 adjacent the top surface 52. The channel 54 can receive a seal 14 (see FIG. 3) that bears against the glass unit of the fixed panel 10. The support beam 50 is hollow and has a first channel 56A between the top surface 52 and a platform 58A that is parallel to the top surface 52. A cutout or slot 58B is defined in the platform 58A. The platform 58A is spaced from the sill platform 44 to define a second channel 56B therebetween. In one implementation, the slot 58B is approximately/inch wide by 2 inches deep.

Figure 5B:
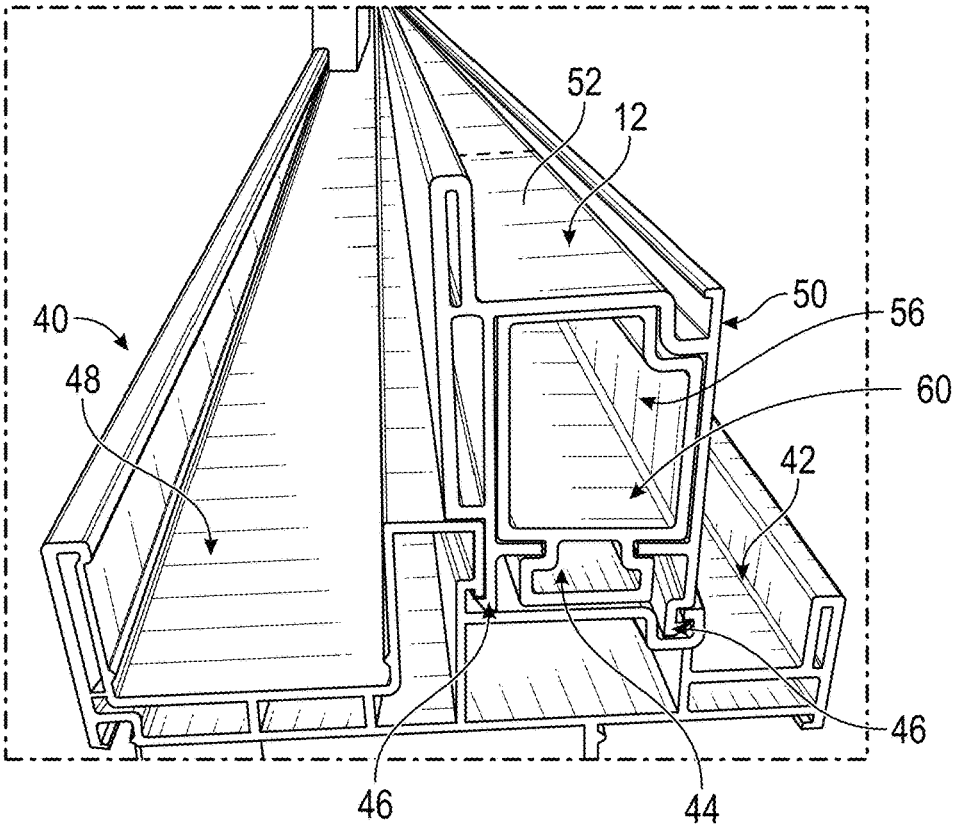
FIG. 5B is a perspective view of the lower frame of the patio door assembly of FIG. 1 with the fixed panel support beam attached and structural insert in place within a cavity of the panel support beam.
Figure 6A:
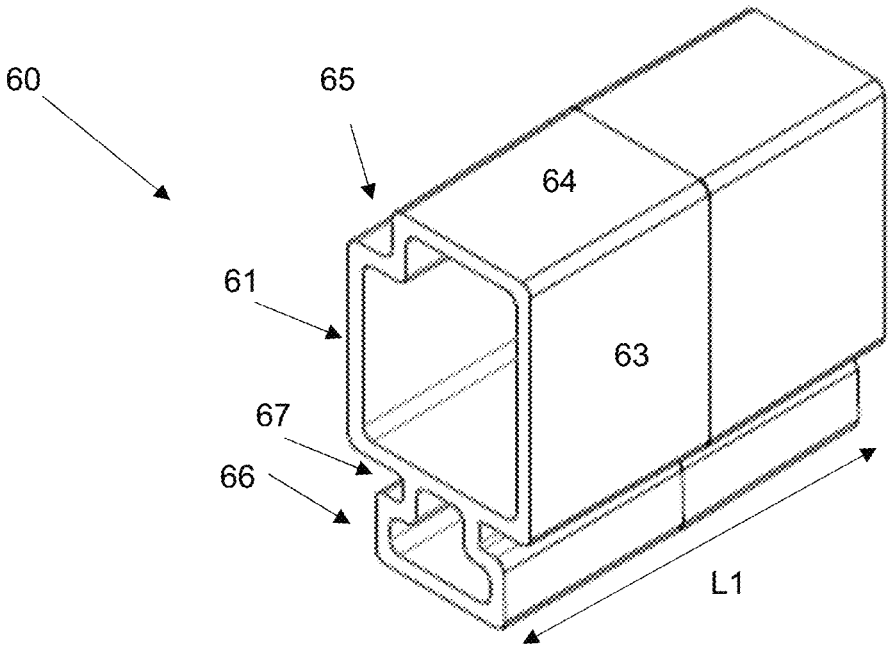
FIG. 6A is a perspective view of a structural insert for insertion in the panel support beam of the patio door assembly.
Figure 6B:
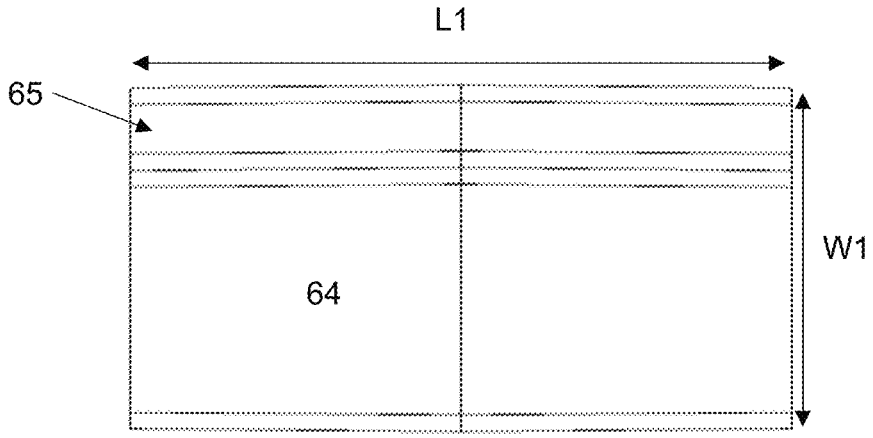
FIG. 6B is a top view of the structural insert of FIG. 6A.
Figure 6C:
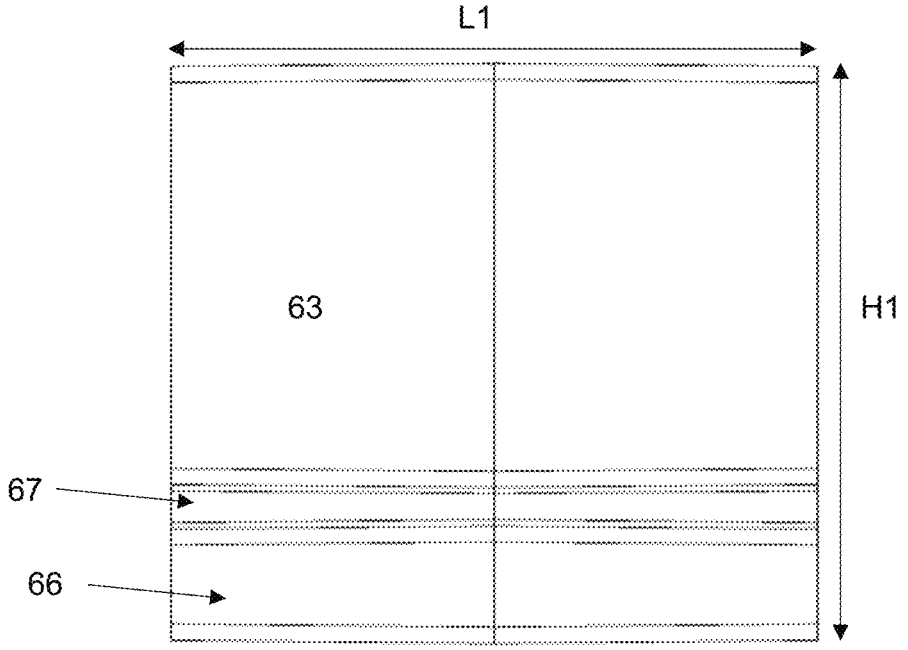
FIG. 6C is a right side view of the structural insert of FIG. 6A.
Figure 6D:
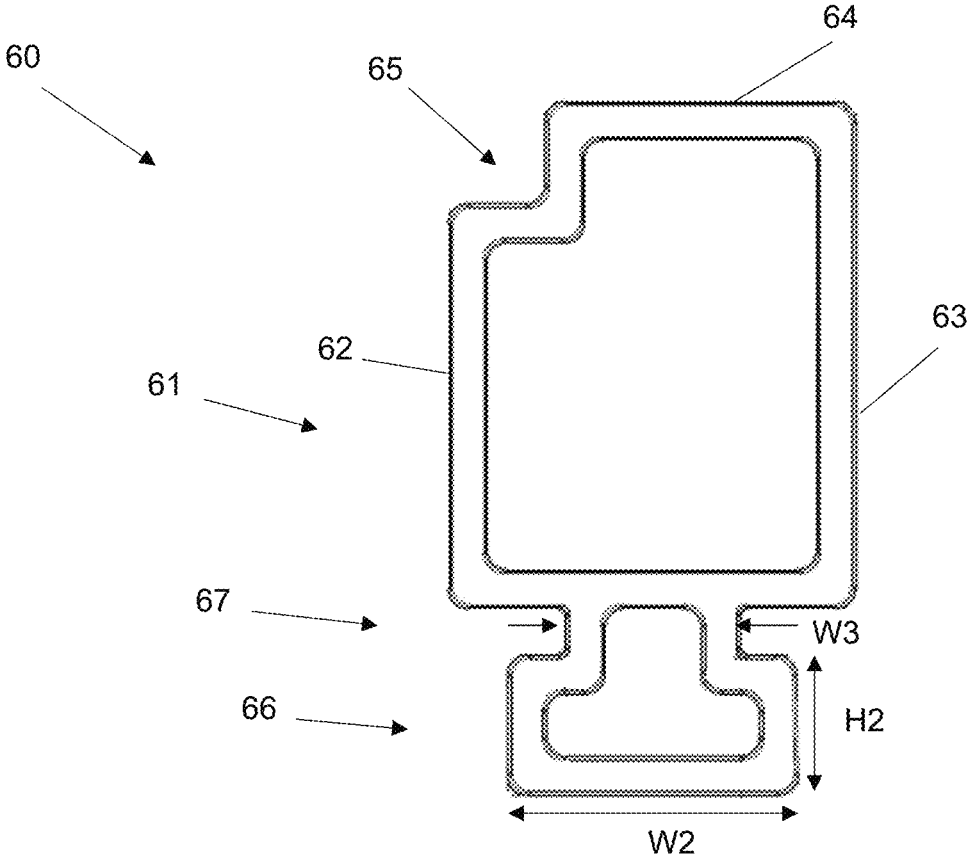
FIG. 6D is an end view of the structural insert of FIG. 6A.

FIG. 5B shows the end view of the bottom member 40 with the structural insert 60 inserted in the support beam 50 so that it extends within the first channel 56A and second channel 56B. In one implementation, the insert 60 has a length L1 of approximately 2 inches, allowing the insert 60 to sit within the support beam 50 across an area 12 over which a setting block of the fixed panel 10 sits, thereby advantageously facilitating transfer of the weight of the fixed panel 10 to the sill platform 44. Structural inserts 60 can be inserted in both ends (e.g., one at each end) of the support beam 50, so that the structural inserts 60 are disposed across the area 12 over which the setting blocks of the fixed panel 10 sits to facilitate transfer of the weight of the fixed panel 10 to the sill platform 44. Advantageously, inserting two structural inserts 60 in both ends of the support beam 50 facilitates (e.g., allows) transfer of the weight of the fixed panel 10 to the sill platform 44 (e.g., without requiring the insert to span the length of the support beam 50), thereby reducing weight and cost of material. Additionally, the structural insert 60 can be inserted in the support beam 50 if the patio door assembly 100 is to be used in a high temperature environment (e.g., a home in a desert environment), while it can optionally be excluded from the support beam 50 if the patio door assembly 100 will not be used in a high temperature environment.

FIGS. 6A-6D show various views of the structural insert 60. The structural insert 60 can be made of a polymer material. In one implementation, the structural insert 60 can be made of nylon. For example, the structural insert 60 can be made of 33% glass filled nylon. The structural insert 60 has a first portion 61 with a first sidewall 62, a second sidewall 63 opposite the first sidewall 62, a top wall 64, and a stepped portion 65 between the top wall 64 and first sidewall 62. The stepped portion 65 can be L shaped (e.g., defined by two walls that are perpendicular to each other). In one implementation, the stepped portion 65 can be about ¼ inch tall and ¼ inch wide. The first sidewall 62 is shorter than the second sidewall 63. The first portion 61 has a width W1 transverse (e.g., perpendicular) to the length L1 of the structural insert 60. In one implementation, the width W1 can be approximately 1 inch. The structural insert 60 also has a second portion 66 with a height H2 and a width W2 that is smaller than the width W1 of the first portion. In one implementation, the width W2 can be approximately ¾ inches. The second portion 66 is disposed below the first portion 61 and interconnected therewith by a neck portion 67. The neck portion 67 has a width W3 smaller than the width W2 of the second portion 66 and approximately the same size as the width of the slot 58B (e.g., less than ½ inch, approximately 0.45 inches). The structural insert 60 has a height H1 (e.g., between a bottom of the second portion 66 and the top wall 64). In one implementation, the height H1 can be about 2 inches (e.g., about 1¾ inches). The first portion 61 and second portion 66 are hollow, which advantageously reduces the weight and material of the structural insert 60.

In use, the structural insert 60 is inserted in each end of the support beam 50 attached to the bottom member 40 of the frame 30 of the patio door assembly 100. That is, two structural inserts 60 are inserted (one in a left end and one in a right end of the support beam 50). The structural insert 60 is inserted so that the first portion 61 extends into the first channel 56A, the second portion 66 extends into the second channel 56B, the stepped portion 65 is positioned adjacent the channel 54, and the neck portion 67 extends in to the slot 58B. The structural insert 60 transfers the weight of the glass unit of the fixed panel 10 to the sill platform 44 while inhibiting (e.g. preventing) deformation of the support beam 50 (e.g., of the channel 54) when exposed to high temperatures (e.g., due to direct and reflected sunlight in a desert environment).

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A patio door assembly, comprising:

a frame including a left member, a right member, a top member and a bottom member;

a first panel fixedly mounted to the frame;

a second panel movably mounted to the frame and being movable relative to the first panel, the bottom member including a sill platform, a support beam being coupleable to the bottom member over the sill platform, the support beam defining a first channel between a top surface of the support beam and a platform, the support beam defining a second channel between the platform and the sill platform, a slot defined in the platform of the support beam; and a structural insert being insertable in opposite ends of the support beam and configured to be positioned in the support beam such that the structural insert supports a setting block for a glass unit of the first panel to facilitate transferring a weight of the first panel to the sill platform, the structural insert having a first portion sized to fit in the first channel, a second portion sized to fit in the second channel, and a neck portion that interconnects the first portion and the second portion, the neck portion sized to fit in the slot in the platform of the support beam.

2. The patio door assembly of claim 1, wherein the second portion of the structural insert has a width that is smaller than a width of the first portion of the structural insert.

3. The patio door assembly of claim 1, wherein the structural insert has a stepped portion between a top wall and a side surface of the first portion of the structural insert.

4. The patio door assembly of claim 3, wherein the stepped portion supports a channel of the support beam configured to receive a seal.

5. The patio door assembly of claim 1, wherein the structural insert has a length of approximately 1 inch.

6. The patio door assembly of claim 1, wherein the structural insert has a width of approximately 1 inch.

7. The patio door assembly of claim 1, wherein the frame is made of vinyl.

8. The patio door assembly of claim 1, wherein the structural insert is made of nylon.

9. The patio door assembly of claim 1, wherein the first portion and the second portion of the structural insert are hollow.

10. A patio door assembly, comprising:

a panel including a glass unit;

a frame including a bottom member, the panel fixedly mounted to the frame, the bottom member including a sill platform, a support beam being coupleable to the bottom member over the sill platform, the support beam defining a first channel between a top surface of the support beam and a platform, the support beam defining a second channel between the platform and the sill platform, a slot defined in the platform of the support beam; and a structural insert being insertable in an end of the support beam and positionable in the support beam such that the structural insert is configured to support a setting block for the glass unit of the panel to facilitate transferring a weight of the panel to the sill platform, the structural insert having a first portion sized to fit in the first channel, a second portion sized to fit in the second channel, and a neck portion that interconnects the first portion and the second portion, the neck portion sized to fit in the slot in the platform of the support beam.

11. The patio door assembly of claim 10, wherein the second portion of the structural insert has a width that is smaller than a width of the first portion of the structural insert.

12. The patio door assembly of claim 10, wherein the structural insert has a stepped portion between a top wall and a side surface of the first portion of the structural insert.

13. The patio door assembly of claim 12, wherein the stepped portion supports a channel of the support beam configured to receive a seal.

14. The patio door assembly of claim 10, wherein the structural insert has a length of approximately 1 inch.

15. The patio door assembly of claim 10, wherein the structural insert has a width of approximately 1 inch.

16. The patio door assembly of claim 10, wherein the frame is made of vinyl.

17. The patio door assembly of claim 10, wherein the structural insert is made of nylon.

18. The patio door assembly of claim 10, wherein the first portion and the second portion of the structural insert are hollow.

19. A frame for a patio door assembly, comprising:

a bottom member including a sill platform;

a support beam being coupleable to the bottom member over the sill platform and configured to receive a glass unit of a fixed panel thereon, the support beam defining a first channel between a top surface of the support beam and a platform, the support beam defining a second channel between the platform and the sill platform, a slot defined in the platform of the support beam; and a structural insert being insertable in an end of the support beam and positionable in the support beam such that the structural insert is configured to support a setting block for the glass unit of the fixed panel to facilitate transferring a weight of the fixed panel to the sill platform, the structural insert having a first portion sized to fit in the first channel, a second portion sized to fit in the second channel, and a neck portion that interconnects the first portion and the second portion, the neck portion sized to fit in the slot in the platform of the support beam.

20. The frame for a patio door assembly of claim 19, wherein the structural insert has a stepped portion between a top wall and a side surface of the first portion of the structural insert, the stepped portion configured to support a channel of the support beam that is configured to receive a seal.

* * * * *